US005664784A

United States Patent [19]

Redlich et al.

[11] Patent Number: 5,664,784

[45] Date of Patent: Sep. 9, 1997

[54] REBOUND NET SYSTEM FOR SPORTS BALLS

[75] Inventors: George R. Redlich; Katie J. Redlich, both of Peachtree City, Ga.

[73] Assignee: Goal Products, Inc., Peachtree City, Ga.

[21] Appl. No.: 607,716

[22] Filed: Feb. 27, 1996

[51] Int. Cl.[6] ..... A63B 63/00

[52] U.S. Cl. ..... 273/396; 273/400; 473/197; 473/454; 473/476; 473/462; 473/446

[58] Field of Search ..... 273/394, 401, 273/402, 400, 411, 271, 264, 29; 473/197, 446, 454, 462, 476

[56] References Cited

U.S. PATENT DOCUMENTS

| | | | |
|---|---|---|---|
| 2,823,034 | 2/1958 | Bingham | 273/26 A |
| 3,711,092 | 1/1973 | Hogue | 273/26 A |
| 4,153,246 | 5/1979 | Byrne . | |
| 4,183,524 | 1/1980 | Kifferstein et al. . | |
| 4,326,717 | 4/1982 | McClimon | 473/197 |
| 4,521,016 | 6/1985 | Tominaga . | |
| 4,523,760 | 6/1985 | Bednarczuk . | |
| 4,948,147 | 8/1990 | Pallanca | 273/26 A |
| 4,993,709 | 2/1991 | Tominaga . | |
| 5,007,645 | 4/1991 | Weigl et al. . | |
| 5,116,056 | 5/1992 | Schmutte | 473/197 |
| 5,178,384 | 1/1993 | Gorman . | |
| 5,180,167 | 1/1993 | Felix . | |
| 5,277,430 | 1/1994 | Naccarato . | |
| 5,342,063 | 8/1994 | O'Brien et al. . | |
| 5,354,051 | 10/1994 | Fehrenbach et al. . | |

*Primary Examiner*—Mark S. Graham
*Attorney, Agent, or Firm*—Hinkle & Associates, P.C.

[57] ABSTRACT

A rebound net 10 having a reinforced periphery 20 that can be removably attached to a structure surrounding a door opening of domestic garage. The net 10, while attached to the structure 24, substantially closes the opening 22. The periphery 20 of the rebound net 10 is removably attached to the structure 24 by a first means 26 of an eye bolt 28 and a snap hook 30, a second means 40 of a J-type screw hook 42 and an adjustable strap 44 and a third means 54 of an anchor pin 56 and a shock cord hooks 58. Tension on the rebound net 10 is adjusted by the adjustable strap 44.

5 Claims, 2 Drawing Sheets

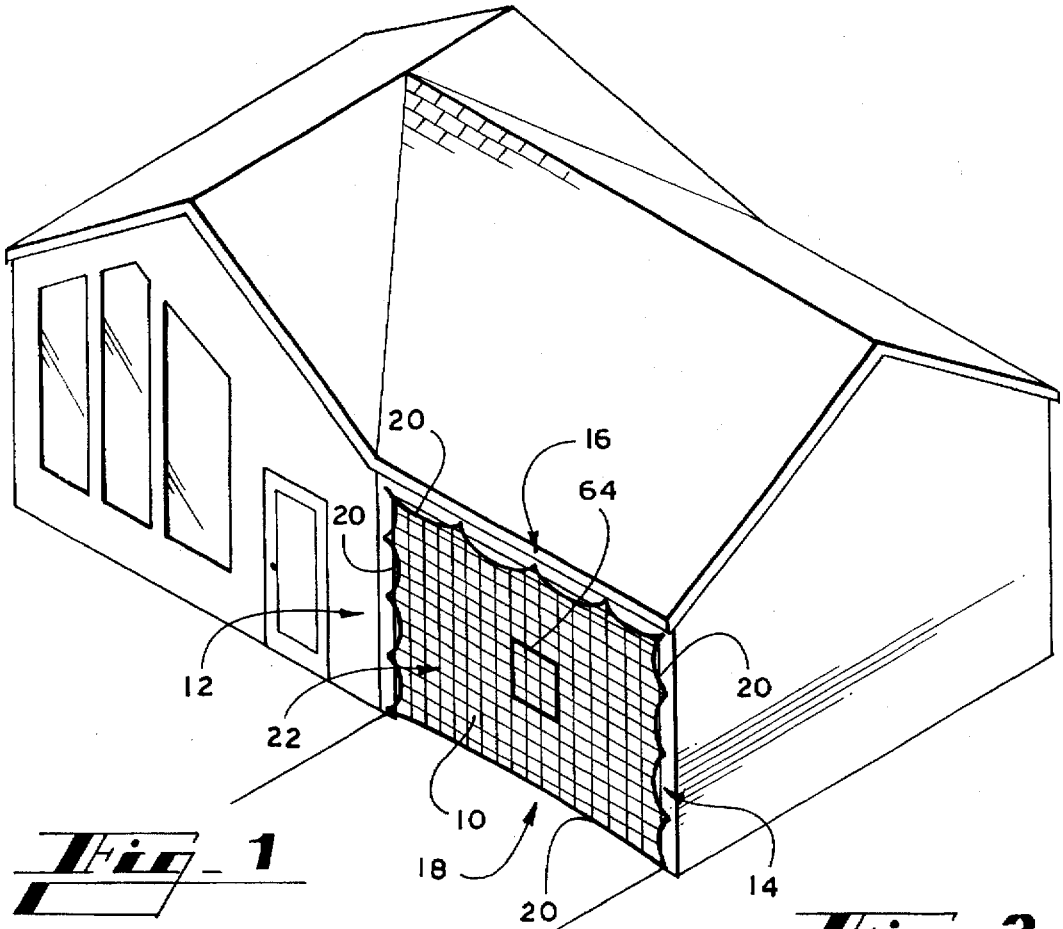
Fig_1
Fig_2
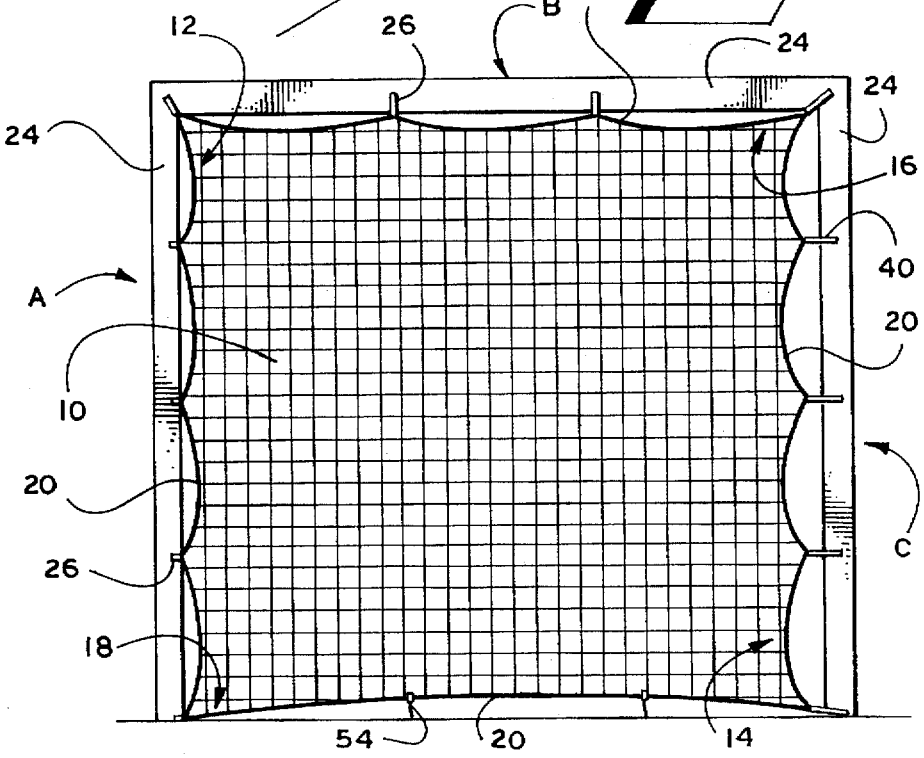

REBOUND NET SYSTEM FOR SPORTS BALLS

BACKGROUND OF THE INVENTION

I. Field of the Invention.

The present invention relates generally to the field of home practice nets. More particularly, the present invention relates both to a net associated with the framing structure of a domestic garage opening to be operable as a rebound net with adjustable tension for ball games such as soccer, baseball, tennis and the like, which is simple to install and store, and a kit containing the component parts for the installation of the rebound net.

II. Description of the Prior Art.

Often individuals desire to practice various ball games such as, soccer, baseball, tennis and the like, to increase their skills and strength. In domestic locations, availability of space and cost prohibit the construction of a permanent apparatus for rebounding a ball. Typically, a domestic garage has a hard surface, such as concrete or asphalt, directly in front of a garage opening. The location is adequate for the practice, but due to unsightly marks left on a garage door, the door is inadequate to be used as the rebounding apparatus. Therefore, there is a need for a rebound net that is inexpensive, simple to install and easy to store. Also, there is a need for a kit containing the necessary parts to construct the rebound net on a structure around the garage opening.

Various forms of netting have been devised, but are not adequate for the aforementioned needs. Some of the devices are complicated and not well suited for the ball game practice. Others are designed to be attached to the garage door, but not to the structure of the opening.

U.S. Pat. No. 4,993,709 granted to Tominaga has a loosely put-up net associated with a target device which determines a speed of a ball flying toward the net. The net is suspended from a metal framing system.

A device placed above a tennis net described in U.S. Pat. No. 5,354,051 by Fehrenbach et al discloses a target system so that a tennis ball may be rebounded with an unpredictable trajectory.

U.S. Pat. No. 4,153,246 granted to Byrne shows a sports net mounted within the domestic garage above the top frame member of the opening. The net is on a plastic roller with a reel for storing and lowering the netting.

A practice net is described in U.S. Pat. No. 4,183,524 by Kifferstein et al has a net attached to the garage door. The net is provided with a tension adjustment screw and a ground engaging structure using cylindrical sleeves embedded within the driveway surface area.

U.S. Pat. No. 5,007,645 granted to Weigl et al describes a golf practice net which can be used either within or outside the domestic garage. One end of the net is mounted internally to the garage door adjacent to an upper edge. The other end of the net is weighted.

A free hanging practice goal shown in U.S. Pat. No. 5,277,430 by Naccarato has a flexible panel loosely attached to the structure around the garage door opening.

SUMMARY OF THE INVENTION

In accordance with the present invention and the contemplated problems that have existed and continue to exist in this field, the objectives of this invention are to provide a rebound net which:

Serves as a sports training aid;

Has an inexpensive net with a reinforced periphery;

Has adjustable tension

Has simple installation;

Utilizes an existing domestic garage;

Requires no device to be inserted below the surface of a driveway;

Removably attaches to a structure of the garage door opening;

Easily removes for storage; and

Requires very little storage space.

This invention accomplishes the above and other objectives with a rebound net mounted to a domestic garage. The idea behind the invention is to use the garage door opening in a novel way to removably attach the rebound net in an inexpensive manner. The rebound net has sufficient pliancy to accept the stress of a ball being delivered to it at high velocity. Installed, the rebound net can have a width from 8 to 18 feet and a height of 7 to 8 feet. It is an open weave net made of nylon having four sides and a reinforced periphery. Two sides of the rebound net are removably attached to the garage door opening structure by a first attaching means consisting of eye bolts and snap hooks. The eye bolts are attached to the structure of the garage door opening and the snap hooks are removably attached to both the periphery of the net and the eye bolts. Another side of the rebound net is removably attached to the garage door opening structure by a second attaching means consisting of J-type screw hooks and adjustable straps. The J-type screw hooks are attached to the structure of the garage door opening and the strap is removably attached to both the periphery of the net and the screw hook. A forth side of the rebound net is removably attached to the ground directly beneath the structure of the garage door opening by a third attaching means of anchor pins and shock cord hooks. The anchor pin is mounted to the ground by epoxy putty and the shock cord hook is removably attached to both the periphery of the net and the anchor pin. Lateral tension of the rebound net can be adjusted by the adjustable strap. In order to increase the lateral tension, the length of the adjustable strap is shortened. Likewise, to decrease the lateral tension of the net, the length of the adjustable strap is increased.

Other objects, advantages and capabilities of the invention will become apparent from the following description taken in conjunction with the accompanying drawings showing the preferred embodiment of the invention.

BRIEF DESCRIPTION OF THE DRAWINGS

FIG. 1 is a perspective view of a rebound net installed on a domestic garage.

FIG. 2 is a front elevation view of an installed rebound net.

DESCRIPTION OF THE PREFERRED EMBODIMENT

Figure 3:
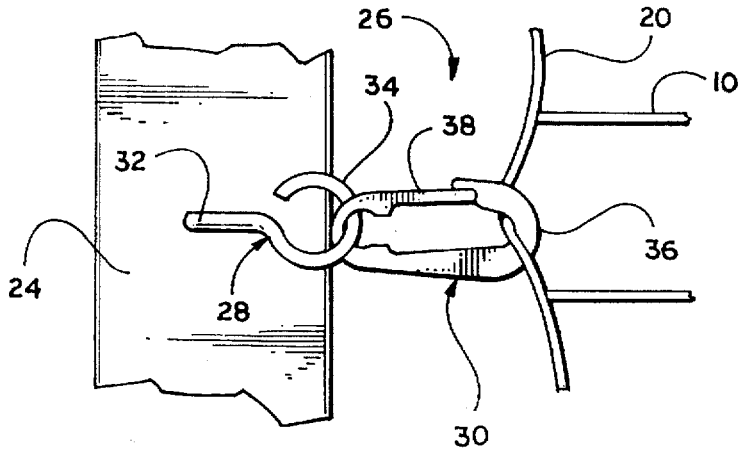
FIG. 3 is a partial elevation view of an eye bolt and a snap hook attaching means.

Referring to the drawings wherein like reference numerals designate corresponding parts throughout the several figures, reference is made first to FIGS. 1 and 2. A rebound net 10 has a first side 12, a second side 14, a top side 16 and a bottom side 18. Preferably, the net 10 is made of nylon in a strong open weave pattern to provide strength and durability for the impact of a ball at high velocity. To provide structural support, the net has a reinforced periphery 20.

In the preferred embodiment, the net 10 can be removably attached to a domestic garage having a garage door opening 22, a structure 24 surrounding the opening 22 and a driveway constructed with a bonded surface, such as asphalt, concrete, brick, pavers or the like, immediate to the opening 22. The structure 24 has an A side, a B side and a C side on the outside of the garage. The net 10 can have a width from 8 to 18 feet and a height of 7 feet. While attached to the structure 24, the net 10 substantially closes the opening 22.

A first attaching means 26 removably attaches the periphery 20 of the first 12 and the top 16 sides of the net 10 to the A and the B sides of the structure 24, respectively, of the garage door opening 22. Referring to FIG. 3, the first attaching means 26 is an eye bolt 28 and a corresponding snap hook 30. The eye bolt 28 has a first threaded portion 32 and a looped portion 34. The eye bolt 28 is attached by screwing the first threaded portion 32 of the eye bolt 28 into the structure 24 of the garage door opening 22. On the A side of the structure 24, the eye bolts 28 are spaced 20 inches apart with the eye bolt 28 installation beginning at a point one inch from the driveway. The eye bolts 28 are evenly spaced with a maximum distance of forty-eight inches between eye bolts 28 across the B side of the structure 24. The snap hook 30 is a plastic single unit having a J-shaped portion 36 and a lock member portion 38. The lock member portion is moved away from the J-shaped portion so that the periphery 20 of the net 10 and the looped portion 34 of the eye bolt 28 can slide onto and be removably attached by the snap hook 30.

Figure 4:
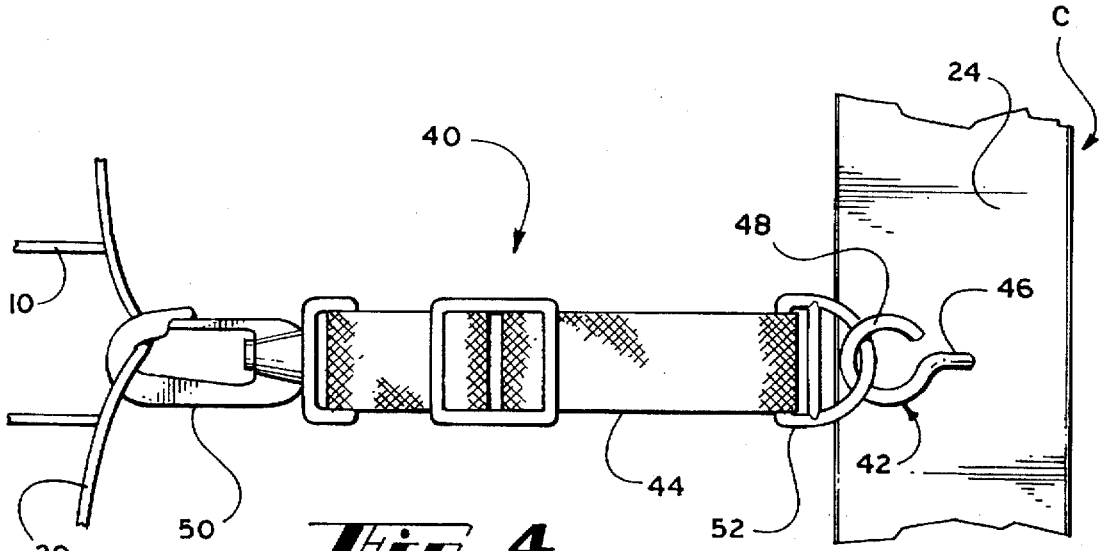
FIG. 4 is a partial elevation view of a J-type screw hook and an adjustable strap attaching means.

A second attaching means 40 removably attaches the periphery 20 of the second side 14 of the net 10 to the C side of the structure 24 of the garage door opening 22. Referring to FIG. 4, the second attaching means 40 is a J-type screw hook 42 and a respective adjustable strap 44. The screw hook 42 has a second threaded portion 46 and a J-type hook portion 48. The screw hook 42 is attached by screwing the second threaded portion 46 of the screw hook 42 into the structure 24 of the garage door opening 22 along the C side. On the C side of the structure 24, the screw hooks 42 are spaced 20 inches apart with the screw hook 42 installation beginning at a point one inch from the driveway. The strap 44 is constructed of nylon and has a plastic clip hook member 50 attached to one end and a plastic D-shaped member 52 attached to the other end. The clip hook member 50 removably dips onto the periphery 20 of the net 10 at the second side 14. The D-shaped member removably engages the J-type hook portion 48 of the screw hook 42.

Figure 5:
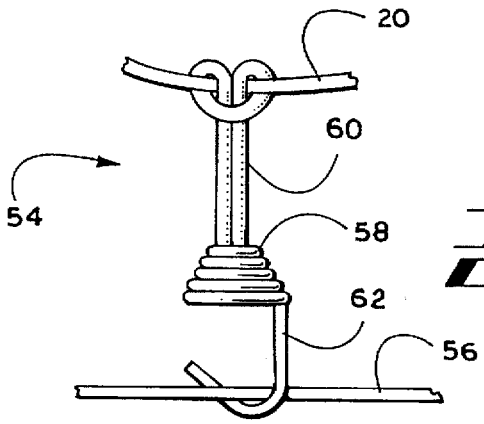
FIG. 5 is a partial elevation view of an anchor pin and a shock cord hook attaching means.

A third attaching means 54 removably attaches the periphery 20 of the bottom side 18 of the net 10 to the driveway. Referring to FIG. 5, the third attaching means 54 is a ground anchor pin 56 and a corresponding shock cord hook 58. The anchor pin 56 has two ends and is mounted at the ends to the surface of the driveway by an epoxy, preferably an epoxy putty. After the initial installation of the eye bolts 28 into the C side of the structure 24 of the garage door opening 22, the anchor pin 56 is mounted to the driveway surface directly below the aforementioned eye bolts 28. The anchor pin 56, after installation, has at least one-quarter inch clearance between the anchor pin 56 and the driveway surface and at least one-haft inch of exposed anchor pin 56 between the two ends mounted in epoxy putty. The shock cord hook 58 has an elastic bungee cord portion 60 and a hook portion 62. The bungee cord portion 60 removably loops around the periphery 20 of the net 10 at the bottom side and the hook portion 62 removably clips onto and engages the anchor pin 56. Due to the elasticity of the bungee cord portion 60, the shock cord hook 58 maintains horizontal tension upon the net 10 and assists in absorbing energy from the ball striking the net 10.

The lateral tension on the rebound net 10 can be adjusted by the adjustable strap 44. To increase lateral tension on the net 10, shorten the length of the adjustable strap 44. Likewise, to decrease lateral tension, the length of the adjustable strap 44 is increased.

In the preferred embodiment, a goal strap 64 is removably placable into the net to indicate a target location on the net for the ball game of choice.

Various modifications may be made of the invention without departing from the scope thereof and it is desired, therefore, that only such limitations shall be placed thereon as are imposed by the prior art and which are set forth in the appended claims.

What is claimed is:

1. In combination with a domestic garage having a garage door opening, a structure surrounding the same and a driveway immediate to the opening, the structure having an A side, a B side and a C side, a rebound net for use in connection with ball games such as soccer, baseball, tennis and the like, comprising:

a net having a reinforced periphery adapted to be removably secured to the structure around the garage door opening and to at least substantially close the opening, the net having a first side, a second side, a top side and a bottom side, a first attaching means for removably attaching the periphery at the first and the top sides of the net to the A and the B sides of the structure, respectively, of the garage door opening, a second attaching means for removably attaching the periphery at the second side of the net to the C side of the structure of the garage door opening, and a third attaching means for removably attaching the periphery at the bottom side of the net to the driveway, the third attaching means having at least one ground anchor pin and a respective shock cord hook, the anchor pin being mounted to the driveway by a bonding material and the shock cord hook being removably attached to both the periphery of the net at the bottom side and the anchor pin.

2. The net according to claim 1, wherein the bonding material is epoxy.

3. In combination with a domestic garage having a garage door opening, a structure surrounding the same and a driveway immediate to the opening, the structure having an A side, a B side and a C side, a rebound net for use in connection with ball games such as soccer, baseball, tennis and the like, comprising:

a net having a reinforced periphery adapted to be removably secured to the structure around the garage door opening and to at least substantially close the opening, the net having a first side, a second side, a top side and a bottom side;

a first attaching means for removably attaching the periphery at the first and the top sides of the net to the A and the B sides of the structure, respectively, of the garage door opening;

a second attaching means for removably attaching the periphery at the second side of the net to the C side of the structure of the garage door opening, the second attaching means having at least one J-type screw hook and a respective strap, the screw hook being attached to the C side of the structure of the garage door opening and the strap having a clip hook member at one end removably attached to the periphery of the net at the second side and being removably attached to the screw hook at an opposite end; and a third attaching means for removably attaching the periphery at the bottom side of the net to the driveway.

4. The net according to claim 3, wherein the strap has an adjustable length, whereby tension on the net increases as the distance between the C side of the net and the screw hook decreases.

5. A kit for establishing a rebound net in combination with a domestic garage having a garage door opening, a structure surrounding the same and a driveway having a surface immediate the opening, the structure having an A side, a B side and a C side, comprising:

a net having a reinforced periphery adapted to be secured to the structure around the garage door opening and to at least substantially close the same, the net having a first side, a second side, a top side and a bottom side, a plurality of eye bolts to be attached to the A and the B sides of the structure, a snap hook for each of the eye bolts to be removably attached to both the periphery of the net at the first and top sides and the respective eye bolts, a plurality of J-type screw hooks to be attached to the C side of the structure, an adjustable strap for each screw hook to be removably attached to both the periphery at the second side of the net and the screw hook for adjusting the tension of the net, at least one anchor pin to be mounted to the driveway surface, a predetermined mount of epoxy for mounting the anchor pin to the driveway, at least one shock cord to be removably attached to both the periphery of the net at the bottom side and the anchor pin, and a goal strap to be removably placeable into the net for indicating a target location on the net for a ball game of choice.

* * * * *